US006120709A

United States Patent [19]

Ishikawa et al.

[11] Patent Number: 6,120,709

[45] Date of Patent: Sep. 19, 2000

[54] ELECTROCONDUCTIVE RESIN COMPOSITION

[75] Inventors: Manabu Ishikawa, Ichihara; Takeshi Fujii, Sodegaura, both of Japan

[73] Assignee: Sumitomo Chemical Company, Limited, Osaka, Japan

[21] Appl. No.: 09/307,725

[22] Filed: May 10, 1999

[30] Foreign Application Priority Data

Jun. 3, 1998 [JP] Japan ..... 10-154410

[51] Int. Cl.[7] ..... H01B 1/06

[52] U.S. Cl. ..... 252/511; 252/510; 524/504; 524/505; 525/69; 525/70; 525/98

[58] Field of Search ..... 252/511, 510; 524/504, 505; 525/98, 69, 70

[56] References Cited

U.S. PATENT DOCUMENTS

| | | | |
|---|---|---|---|
| 4,478,903 | 10/1984 | Kishida et al. . | |
| 5,270,353 | 12/1993 | Nakano et al. | 523/214 |
| 5,902,850 | 5/1999 | Chino et al. | 524/494 |

FOREIGN PATENT DOCUMENTS

| | | |
|---|---|---|
| 6-305084 | 11/1994 | Japan . |
| 10-53677 | 2/1998 | Japan . |

*Primary Examiner*—Yogendra Gupta
*Assistant Examiner*—D. G. Hamlin

[57] ABSTRACT

There is provided an electroconductive resin composition, comprising:

(a) a component containing a styrene based resin;

(b-1) a component containing a rubber like substance having a styrene based tri-block structure;

(b-2) a component containing a rubber like substance having a styrene based polymer graft; and (c) a component containing carbon black having a dibutyl phthalate oil absorption of not less than 70 ml/100 g;

wherein a weight ratio of (a) component/((b-1) component+(b-2) component) is from about 70/30 to 85/15, a weight ratio of (c) component/((a) component+(b-1) component+(b-2) component) is from about 5/100 to 35/100, and a weight ratio of (b-1) component/(b-2) component is from about 20/80 to 90/10.

7 Claims, No Drawings

ELECTROCONDUCTIVE RESIN COMPOSITION

FIELD OF THE INVENTION

The present invention relates to an electroconductive resin composition, whose strength and folding endurance properties are superior and simultaneously optimized, so that the same is particularly and advantageously suitable for use as a packaging material for electronic parts and IC packages.

BACKGROUND OF THE INVENTION

In the electric and electronic fields, a container of an electroconductive embossed tape has been used for protecting electronic parts and IC packages from damage due to electro-static discharge (ESD) as well as packaging said parts and packages. In recent years, an electroconductive embossed tape that is superior in both its strength and folding endurance has been required increasingly due to the need to speed-up packaging processes.

As a resin superior in both its strength and folding endurance, a styrene based resin is known and generally used also for a sheet. However, the styrene based resin cannot meet the aforementioned requirement, because a styrene based resin containing electroconductive particles such as electroconductive carbon black is inferior to a styrene based resin not containing electroconductive particles in its strength and folding endurance.

SUMMARY OF THE INVENTION

An object of the present invention is to provide an electroconductive resin composition that is simultaneously superior in both its strength and folding endurance properties.

The present inventors have undertaken extensive studies to develop an electroconductive resin composition that is simultaneously superior in both its strength and folding endurance, which composition can be suitably used as an electroconductive embossed tape or an electroconductive carrier tape for electronic parts and IC packages.

As a result, it has been found that a resin composition comprising (a) a styrene based resin, (b) two kinds of specific rubber like substances and (c) a specific carbon black in a specific proportion can give a desired electroconductive resin composition that is simultaneously superior in both its strength and folding endurance, and thereby the present invention has been obtained.

The present invention provides an electroconductive resin composition, comprising:

(a) a component containing a styrene based resin;

(b-1) a component containing a rubber like substance having a styrene based tri-block structure;

(b-2) a component containing a rubber like substance having a styrene based polymer graft; and (c) a component containing carbon black having a dibutyl phthalate oil absorption of not less than 70 ml/100 g;

wherein a weight ratio of (a) component/((b-1) component+(b-2) component) is from about 70/30 to 85/15, a weight ratio of (c) component/((a) component+(b-1)component+(b-2) component) is from about 5/100 to 35/100, and a weight ratio of (b-1) component/(b-2) component is from about 20/80 to 90/10.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The (a) component, that is, a styrene based resin is a resin containing not less than about 51% by weight of a resin having at least about 25% by mole of a repeating unit derived from a styrene compound represented by the following formula,

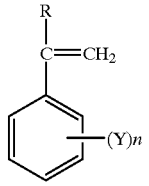

wherein R is hydrogen, $C_{1-6}$ alkyl or halogen, Y is hydrogen, vinyl, halogen, amino, hydroxyl or $C_{1-6}$ alkyl, and n is 0 or an integer of 1 to 5. Specific examples of the styrene compound are styrene, α-methylstyrene, p-methylstyrene, vinyltoluene and chlorostyrene.

The (a) component includes, for example, a homopolymer of the styrene compound; a copolymer of at least two kinds of the styrene compounds; and a copolymer of at least one kind of the styrene compound with at least one kind of other monomer that is copolymerizable therewith.

Examples of said other monomer that is copolymerizable with the styrene compound are vinyl cyanides such as acrylonitrile, methacrylonitrile, fumaronitrile and maleonitrile; (meth)acrylates such as methyl methacrylate and methyl acrylate; acids such as methacrylic acid and acrylic acid; and acid anhydrides such as maleic anhydride.

Specific examples of the (a) components are polystyrene resin, high impact polystyrene resin (so-called "HIPS"), poly α-methylstyrene resin, poly p-methylstyrene resin, styrene-acrylonitrile copolymer resin and styrene-maleic acid copolymer resin. Of these, polystyrene resin and styrene-acrylonitrile copolymer resin are preferred, and polystyrene resin is particularly preferred. However, the (a) component may contain any resin that comprises not less than about 51% by weight of a resin having at least about 25% by mole of a repeating unit derived from a styrene compound represented by the above provided chemical formula.

If desired, the (a) component may be used in combination with other polymers such as polyphenylene ether which is compatible with the (a) component, thereby improving the thermal resistance thereof.

The (b-1) component, that is, a rubber like substance having a styrene based tri-block structure is a rubber like (elastic) substance at room temperature which has a structure of A-B-A', wherein A and A' are independently of each other a styrene compound block of a repeating unit derived from the aforementioned styrene compound, and B is a conjugated diene compound block of a repeating unit derived from a conjugated diene compound.

The conjugated diene compound block B in the (b-1) component includes, for example, blocks of polymers obtained from butadiene, isoprene, or a mixture thereof, and hydrogenated blocks thereof.

Specific examples of the (b-1) component having an A-B-A' structure are styrene block-butadiene block-styrene block copolymer (hereinafter, such a copolymer is referred to as "styrene-butadiene-styrene block copolymer" for brevity), partially hydrogenated styrene-butadiene-styrene block copolymer, styrene-ethylene-butylene-styrene block copolymer, styrene-isoprene-styrene block copolymer, partially hydrogenated styrene-isoprene-styrene block copolymer, styrene-ethylene-propylene-styrene block copolymer. In addition, the (b-1) component may include rubber like substances obtained by modifying block copolymers, such as those exemplified above, with an epoxy compound or an acid such as methacrylic acid, and others, such as those exemplified as being "other" monomers copolymerizable with the (a) component.

Although any known substances may be used as the (b-1) component, rubber like substances such as styrene-ethylene-butylene-styrene block copolymer and styrene-ethylene-propylene-styrene block copolymer are preferably used.

A weight average molecular weight of the (b-1) component is in general not higher than about 200,000, preferably from about 40,000 to 100,000. A weight ratio of the styrene compound blocks to the conjugated diene block, that is, a weight ratio of the sum of the block A and the block A' to the block B, is in general from about 20/80 to 40/60, preferably from about 25/75 to 35/65.

The (b-2) component, that is, a rubber like substance having a styrene based polymer graft is a rubber like (elastic) substance at room temperature which has a graft of a repeating unit derived from the aforementioned styrene compound.

In general, such a rubber like substance can be produced by grafting a rubber like polymer with a styrene compound. Here, the rubber like polymer may be referred to as "rubber block C", and the graft of the styrene compound may be referred to as "styrene compound block A"". Then, the (b-2) component is the one having the rubber block C grafted with the styrene compound block A", and thus, it is reworded as a rubber like (elastic) substance at room temperature which has a structure of A"-graft-C.

The styrene compound block A and block A' in the (b-1) component, and the styrene compound block A" in the (b-2) component include, for example, a block of a homopolymer of the styrene compound such as styrene, α-methylstyrene, p-methylstyrene, vinyltoluene and chlorostyrene; a block of a copolymer of at least two kinds of the styrene compounds; and a block of a copolymer of at least one kind of the styrene compound with at least one kind of other monomer copolymerizable therewith. Examples of said other monomer copolymerizable with the styrene compound are vinyl cyanides such as acrylonitrile, methacrylonitrile, fumaronitrile and maleonitrile; (meth)acrylates such as methyl methacrylate and methyl acrylate; acids such as methacrylic acid and acrylic acid; and acid anhydrides such as maleic anhydride. The styrene compound block A, block A' and block A" are the same or different from one another.

The rubber block C in the (b-2) component includes, for example, a rubber block of ethylene-α-olefin copolymer rubber such as ethylene-propylene copolymer rubber and ethylene-butene-1 copolymer rubber; and a rubber block of ethylene-α olefin-non conjugated diene copolymer rubber such as ethylene-propylene-non conjugated diene copolymer rubber and ethylene-butene-1-non conjugated diene copolymer rubber, wherein a non conjugated diene include, for example, hexadiene, dicyclopentadiene and ethylidene-norbornene.

Specific examples of the (b-2) component are rubber like substances such as styrene block-graft-ethylene-propylene copolymer rubber block copolymer (hereinafter, such a copolymer is referred to "styrene-graft-ethylene-propylene copolymer" for brevity), styrene-graft-ethylene-propylene-non conjugated diene copolymer, styrene/acrylonitrile-graft-ethylene-propylene copolymer, styrene/acrylonitrile-graft-ethylene-propylene-non conjugated diene copolymer, styrene/methyl methacrylate-graft-ethylene-propylene copolymer and styrene/methyl methacrylate-graft-ethylene-propylene-non conjugated diene copolymer. In addition, the (b-2) component may include rubber like substances obtained by modifying copolymers such as those exemplified above for the (b-2) component with an epoxy compound or an acid such as methacrylic acid and others exemplified as other monomers for the (a) component.

Although any known substances may be used as the (b-2) component, rubber like substances such as styrene-graft-ethylene-propylene-non conjugated diene copolymer, styrene/acrylonitrile-graft-ethylene-propylene-non conjugated diene copolymer and styrene/methyl methacrylate-graft-ethylene-propylene-non conjugated diene copolymer are preferably used. A preferred proportion of the styrene compound block A" in the (b-2) component is in general not higher than about 50% by weight.

The (c) component, that is, carbon black has a dibutyl phthalate oil absorption of not less than about 70 ml/100 g, preferably from about 100 ml/100 g to 600 ml/100 g, more preferably from about 150 ml/100 g to 550 ml/100 g. The dibutytl phthalate oil absorption is measured according to the method prescribed in ASTM D2414.

The (c) component may be any known carbon black which is used for coloring and reinforcing rubber and imparting electroconductivity to rubber, and particularly preferred are acetylene black obtained by the thermal decomposition of acetylene gas and Ketjen black produced by the furnace process. When these kinks of carbon black are used, the electroconductivity can be imparted effectively even by using them in a small amount.

Blending proportions of respective components in the electroconductive resin composition in accordance with the present invention are as follows.

A weight ration of (a) component/((b-1) component+(b-2) component) is from about 70/30 to 85/15, preferably from about 72/28 to 78/22. When the (a) component is too little, the strength of the composition obtained becomes insufficient, and when the (a) component is too much, the folding endurance of the composition obtained becomes insufficient.

A weight ratio of (c) component/((a) component+(b-1) component+(b-2) component) is from about 5/100 to 35/100, preferably from about 10/100 to 25/100, more preferably from about 15/100 to 22/100. When the (c) component is too little, the surface specific resistance of the composition obtained becomes high, and when the (c) component is too much, the elongation and folding endurance of the composition obtained become inferior and moreover the processability thereof deteriorates, so that it may become impossible to process into a sheet.

A weight ratio of (b-1) component/(b-2) component is from about 20/80 to 90/10, preferably from about 30/70 to 70/30, more preferably from about 35/65 to 45/55. When the ratio is too low, the elongation and folding endurance of the composition obtained become insufficient, and when the ratio is too high, the strength thereof becomes insufficient, and moreover the (b-1) component cannot be blended satisfactorily with other components, so that a stable composition cannot be obtained at times.

To improve the its processability, the composition in accordance with the present invention may further comprise an additional (d) component of a polyolefin resin. A suitable (d) component is selected from, for example, low density polyethylene, high density polyethylene, straight low density polyethylene, polypropylene and poly 4-methylpentene-1. Of these, low density polyethylene and straight low density polyethylene are preferred.

The blending proportion of the (d) component is usually not more than about 50% by weight, preferably not more than about 40% by weight, more preferably not more than about 35% by weight, based on the weight of the sum of the (b-1) component and the (b-2) component. It is not recommendable to use the (d) component too much, because increase of the (d) component may create a problem of layer-peeling with respect to the molded products formed from said composition, although increases in the (d) component can increase the processability of the composition obtained.

If desired, the composition in accordance with the present invention may additionally comprise conventional additives such as pigments, flame retardants, plasticizers, oxidation inhibitors and weatherproofing agents.

A composition in accordance with the present invention can be produced in any known manner. For example, it can be produced by blending all or some parts of the (a) component, (b) component and (c) component, if desired, together with the (d) component and said additive in a known manner, and then melt-kneading the resultant blend while adding, if necessary, the remaining parts of the components. The blending and the melt-kneading can be carried out, for example, by using a conventional means such as an extruder, a kneader, a roll mixer and a Bumbury's mixer. The order of blending and melt-kneading of the respective components and the method of feeding them in the extruder or other means are also not particularly limited. Further, a processing method of the composition in accordance with the present invention into a sheet, and a processing method of the sheet into a molded product such as an embossed tape for electronic parts and IC packages are not limited, and any known method can be applied therefor.

According to the present invention, there can be provided an electroconductive resin composition superior in both its strength and folding endurance, so that the composition can be particularly and suitably used as packaging materials for electronic parts and IC packages.

The present invention is illustrated in more detail with reference to the following Example and Comparative Examples, which are only illustrative and not to be construed to limit the scope of the present invention. Materials used in the Example and Comparative Examples were as follows.

(a) component: Polystyrene, Sumibrite ST970K (hereinafter referred to as "GP-PS"), a trade mark of Sumitomo Chemical Co., was used.

(b-1) component: Styrene-ethylene-butylene-styrene block copolymer, KRATON G-1652 (hereinafter referred to as "SEBS"), a trade mark of Shell Chemical Co., was used. The weight average molecular weight of the copolymer is 49,000, and a weight ratio of the styrene compound block to the conjugated diene compound block is 29/71.

(b-2) component: Styrene-graft-ethylene-propylene-non conjugated diene copolymer (hereinafter referred to as "SEPR") obtained in the Reference Example 1 mentioned below was used.

(c) component: Carbon black, DENKA BLACK (hereinafter referred to as "CB"), a trade mark of acetylene black having a dibutyl phthalate oil absorption of 212 ml/100 g produced by DENKI KAGAKU KOGYO KABUSHIKI KAISHA, was used.

(d) component: Low density polyethylene, EXCELLEN VL100 (hereinafter referred to as "PO"), a trade mark of Sumitomo Chemical Co., was used.

REFERENCE EXAMPLE 1

In a 5 liter autoclave equipped with a stirrer, a solution prepared by dissolving 6 g of a dispersing agent, PLURONIC F68, a trade mark of ASAHI DENKA KOGYO K. K., in 2,200 ml of purified water and 300 g of rubber, Esprene E502, a trade mark of ethylene-propylene-non conjugated diene copolymer rubber having a propylene content of 44% by weight, an iodine value of 8.5 and a Mooney viscosity at 120° C. of 63, produced by Sumitomo Chemical Co., which had been cut to pieces of 3 to 6 mm square, were placed and then stirred to obtain a suspension of rubber. Successively, to the suspension, 9 g of t-butyl peroxypivalate and 0.18 g of p-benzoquinone as a polymerization initiator and 300 g of styrene as a monomer were added, and immediately thereafter, the autoclave was dipped in an oil bath of 30° C. The temperature was raised to 110° C. at a ratio of about 1° C./min. and maintained at that level for 30 minutes. The resulting granular product was washed with water and then dried under vacuum at 95° C. to obtain SEPR.

EXAMPLE 1 AND COMPARATIVE EXAMPLES 1 AND 2

Respective components in blending proportions (by weight) as shown in Table 1 were blended with one another, and then extruded through TEM 50 type twin screw extruder manufactured by TOSHIBA MACHINE CO. at a cylindrical temperature of 230° C. The extrudate was cooled in a water bath and then pelletized with a strand cutter. The resulting pellet was hot air-dried at 80° C. for 4 hours, and thereafter the dried pellet was extruded through a 20 mm sheet processing machine manufactured by Tanabe Plastics Machinery Co., Ltd. at a cylindrical temperature of 240° C. The extrudate was wound up with a roller and cooled to obtain a sheet of 0.2 mm thickness. A test piece prepared from the sheet was tested as follows. The results were as shown in Table 1.

(1) Surface specific resistance (Ω)

With respect to the test piece of 70 mm×70 mm size, the surface specific resistance (referred to as "S.S.R.") was measured according to JIS K6911. In the present invention, a preferred S.S.R. is not higher than $10^{10}$ Ω.

(2) Tensile strength (MPa)

According to JIS K7113, a test piece was prepared by processing the sheet at a direction parallel to the sheet-extruding direction (hereinafter referred to as "machine direction (MD)"), and then the tensile strength thereof was measured. In the present invention, a preferred tensile strength is not lower than 33.4 MPa.

(3) Tensile elongation (%)

According to JIS K7113, a test piece was prepared by processing the sheet at the machine direction, and then the tensile elongation thereof was measured. In the present invention, a preferred tensile elongation is not less than 10%.

(4) Degree of folding endurance (the number of times)

According to JIS P8115, a test piece was prepared by processing the sheet at the machine direction, and the number of folding endurance was counted at a bending angle of 90°. In the present invention, a preferred number of folding endurance is not less than 50 times.

(5) Layer-peeling

○: There is observed no layer-peeling on the sheet obtained by the aforementioned sheet-processing.

X: There is observed layer-peeling on the sheet.

In the present invention, it is natural that no layer-peeling is desired.

TABLE 1

| | Example 1 | Comparative Example 1 | Comparative Example 2 |
|---|---|---|---|
| Components | | | |
| (a) GP-PS | 75.0 | 63.0 | 63.2 |
| (b-1) SEBS | 6.3 | 37.0 | 0 |
| (b-2) SEPR | 10.7 | 0 | 21.0 |
| (c) CB | 18.0 | 18.0 | 18.0 |
| (d) PO | 8.0 | 0 | 15.8 |
| Blending proportion of components | | | |
| (a)/((b − 1) + (b − 2)) | 82/18 | 63/37 | 75/25 |
| (c)/((a) + (b − 1) + (b − 2)) | 20/100 | 18/100 | 21/100 |
| (b − 1)/(b − 2) | 37/63 | — | — |
| Evaluation results | | | |
| S.S.R. (Ω) | $10^4$ | $10^4$ | $10^4$ |
| Tensile strength (MPa) | 36.3 | 25.5 | 30.4 |
| Tensile elongation (%) | 14 | 52 | 5 |
| Folding endurance | 63 | 926 | 24 |
| Layer-peeling | ○ | ○ | ○ |

As shown in the Comparative Examples 1 and 2, a composition not containing (b-1) component or (b-2) component cannot give an electroconductive resin composition that is simultaneously superior in both its strength and folding endurance.

Whereas, as shown in the Example 1 in accordance with the present invention, a composition comprising both the (b-1) component and the (b-2) component as well as respective components in specific proportions can give an electroconductive resin composition that is simultaneously superior in both its strength and folding endurance, which can be suitably used, for example, as an electroconductive embossed tape or an electroconductive carrier tape for electronic parts and IC packages.

What is claimed is:

1. An electroconductive resin composition, comprising:

(a) a component containing a styrene based resin;

(b-1) a component containing a modified rubber having a styrene based tri-block structure;

(b-2) a component containing a modified rubber having a styrene based polymer graft; and (c) a component containing carbon black having a dibutyl phthalate oil absorption of not less than 70 ml/100 g;

wherein the weight ratio of (a) component/((b-1) component+(b-2) component) is from about 70/30 to 85/15, the weight ratio of (c) component/((a) component+(b-1) component+(b-2) component) is from about 5/100 to 35/100, and the weight ratio of (b-1) component/(b-2) component is from about 20/80 to 90/10.

2. The electroconductive resin composition according to claim 1, wherein the (a) component comprises a polystyrene resin.

3. The electroconductive resin composition according to claim 1, wherein the (b-1) component comprises a styrene-ethylene-butylene-styrene block copolymer or a styrene-ethylene-propylene-styrene block copolymer.

4. The electroconductive resin composition according to claim 1, wherein the (b-2) component comprises a styrene-graft-ethylene-propylene-non conjugated diene copolymer, a styrene/acrylonitrile-graft-ethylene-propylene-non conjugated diene copolymer or styrene/methyl methacrylate-graft-ethylene-propylene-non conjugated diene copolymer.

5. The electroconductive resin composition according to claim 1, wherein the composition further comprises a (d) a component containing a polyolefin resin in a proportion of not more than about 50% by weight based on the weight of the sum of the (b-1) component and the (b-2) component.

6. A sheet formed from an electroconductive resin composition comprising:

(a) a component containing a styrene based resin;

(b-1) a component containing a modified rubber having a styrene based tri-block structure;

(b-2) a component containing a modified rubber having a styrene based polymer graft; and (c) a component containing carbon black having a dibutyl phthalate oil absorption of not less than 70 ml/100 g;

wherein the weight ratio of (a) component/((b-1) component+(b-2) component) is from about 70/30 to 85/15, the weight ratio of (c) component/((a) component+(b-1) component+(b-2) component) is from about 5/100 to 35/100, and the weight ratio of (b-1) component/(b-2) component is from about 20/80 to 90/10.

7. An embossed tape or a carrier tape for electronic parts and IC packages formed from an electroconductive resin composition comprising:

(a) a component containing a styrene based resin;

(b-1) a component containing a modified rubber having a styrene based tri-block structure;

(b-2) a component containing a modified rubber having a styrene based polymer graft; and (c) a component containing carbon black having a dibutyl phthalate oil absorption of not less than 70 ml/100 g;

wherein the weight ratio of (a) component/((b-1) component+(b-2) component) is from about 70/30 to 85/15, the weight ratio of (c) component/((a) component+(b-1) component+(b-2) component) is from about 5/100 to 35/100, and the weight ratio of (b-1) component/(b-2) component is from about 20/80 to 90/10.

* * * * *